US008876419B2

(12) United States Patent
Sugimura et al.

(10) Patent No.: US 8,876,419 B2
(45) Date of Patent: Nov. 4, 2014

(54) PRINTING SYSTEM, SHEET PROCESSING SYSTEM, AND SHEET DIRECTION CHANGING APPARATUS

(75) Inventors: Hideo Sugimura, Tokyo (JP); Takashi Nojima, Tokyo (JP); Shinya Asano, Tokyo (JP)

(73) Assignee: Canon Kabushiki Kaisha, Tokyo (JP)

( * ) Notice: Subject to any disclaimer, the term of this patent is extended or adjusted under 35 U.S.C. 154(b) by 169 days.

(21) Appl. No.: 13/051,733

(22) Filed: Mar. 18, 2011

(65) Prior Publication Data

US 2011/0243635 A1 Oct. 6, 2011

(30) Foreign Application Priority Data

Mar. 31, 2010 (JP) ..... 2010-055791

(51) Int. Cl.

| | |
|---|---|
| ***B65H 23/32*** | (2006.01) |
| ***B41F 13/06*** | (2006.01) |
| ***B41J 15/04*** | (2006.01) |
| ***B41J 3/54*** | (2006.01) |
| ***B41J 3/60*** | (2006.01) |

(52) U.S. Cl.

CPC ..... *B41J 15/04* (2013.01); *B65H 2301/132* (2013.01); *B65H 23/32* (2013.01); *B41J 3/543* (2013.01); *B41J 3/60* (2013.01)

USPC ..... 400/607; 400/612; 101/222

(58) Field of Classification Search

CPC ..... B65H 2301/121; B65H 2301/122

USPC ..... 400/611, 612, 607, 608.4; 399/384; 242/615.12, 615.21; 101/230

IPC .. B65H 23/32, 23/26; B41F 13/06; B41J 15/18, B41J 15/22

See application file for complete search history.

(56) References Cited

U.S. PATENT DOCUMENTS

| | | | | |
|---|---|---|---|---|
| 5,647,582 | A * | 7/1997 | Shiba | 270/8 |
| 6,120,142 | A * | 9/2000 | Eltgen et al. | 347/104 |
| 6,575,399 | B1 * | 6/2003 | Lamothe | 242/615.21 |
| 2003/0047643 | A1 | 3/2003 | Lamothe | |
| 2003/0080240 | A1 * | 5/2003 | Lamothe | 242/615.21 |
| 2003/0167943 | A1 * | 9/2003 | Izawa et al. | 101/223 |
| 2005/0016401 | A1 * | 1/2005 | Takahashi et al. | 101/424.1 |
| 2007/0041049 | A1 * | 2/2007 | Kojima et al. | 358/1.16 |

FOREIGN PATENT DOCUMENTS

| | | | |
|---|---|---|---|
| CN | 2543710 | Y | 4/2003 |
| CN | 1854917 | A | 11/2006 |
| CN | 1892465 | A | 1/2007 |
| CN | 1916783 | A | 2/2007 |
| JP | 49-060801 | U | 5/1974 |

(Continued)

*Primary Examiner* — Daniel J Colilla
*Assistant Examiner* — Ruben Parco, Jr.
(74) *Attorney, Agent, or Firm* — Canon USA Inc. IP Division

(57) ABSTRACT

In a printing system capable of selectively performing duplex printing and simplex printing, a first input unit and a second input unit are adjacent to each other. A first output unit and a second output unit are adjacent to each other. In duplex printing, a sheet supplied from the first input unit is printed on a first side thereof in a first printing apparatus and the traveling direction thereof is changed at a changing unit while the sheet is reversed, and then the sheet is printed on a second side thereof in a second printing apparatus and output to the second output unit. In simplex printing, a sheet supplied from the first or second input unit is printed on one side thereof and the traveling direction thereof is changed at the changing unit, and then the sheet is output to the first or second output unit.

13 Claims, 11 Drawing Sheets

(56) References Cited

FOREIGN PATENT DOCUMENTS

| | | | |
|---|---|---|---|
| JP | 2-138063 | A | 5/1990 |
| JP | 2000-019791 | A | 1/2000 |
| JP | 2003-260779 | A | 9/2003 |
| JP | 2007-050600 | A | 3/2007 |
| JP | 3944834 | B2 | 7/2007 |

* cited by examiner

PRINTING SYSTEM, SHEET PROCESSING SYSTEM, AND SHEET DIRECTION CHANGING APPARATUS

TECHNICAL FIELD

The present invention relates to a system capable of performing processing on sheets such as printing at high speed.

BACKGROUND ART

A printing system in which a plurality of printing apparatuses are combined and operated in parallel with each other in order to improve the productivity of printing (printing output on a time basis) is known. For example, in a printing system disclosed in PTL 1, duplex printing and simplex printing are selectively performed on roll sheets (roll of printing media) using a two line configuration including two simplex printing apparatuses.

CITATION LIST

Patent Literature

PTL 1: Japanese Patent No. 3944834

In the entire process performed in a printing factory, there are various processing steps before and after a printing step. The step of a pre-coating process in which coating is performed on a surface of a sheet to be printed may be performed before the printing step. After the printing step, a cutting step performed for a roll of printing media that has been printed and wound, a folding step for the purpose of bookbinding, and the like may be performed. Considering the work of carrying rolls of printing media from/to different processing apparatuses used for the steps performed before and after the printing step, the printing system described in PTL 1 has problems to be solved, which will be listed below.

(1) An excessive workload is imposed on a worker who performs the operation of carrying-in a roll from a pre-processing apparatus to a printing line (inputting a sheet to the printing line) and carrying-out the printed rolls to a post-processing apparatus (outputting a sheet from the printing line).

In the layout of PTL 1 (as illustrated in FIG. 1 and FIG. 2 of PTL 1), two input units are set for two printing lines. The two lines are widely separated and distant from each other. In these circumstances, when the two input units are distant from each other, the carrying distance over which rolls are carried from the pre-processing apparatus in the carrying-in work is large. In addition, in terms of carrying-out, two output units from which printed rolls are carried out for the two lines are widely separated and distant from each other. When the two output units are distant from each other, the carrying distance over which rolls are carried to the post-processing apparatus in the carrying-out work is large. In a large printing system, the length of the lines may exceed 10 m, and rolls to be used may each weigh several tens of kilograms. A large carrying distance directly results in an increased workload to be imposed on a worker.

(2) The floor area required to arrange the printing lines in the factory is large. In the layout of PTL 1 (both FIG. 1 and FIG. 2 of PTL 1), the two input units to which rolls are carried are distant from each other. Therefore, a workspace for a worker is required around each of the two input units. A workspace is also required around each of the two output units from which rolls are carried. That is, workspaces are required at four places in total and accordingly the floor area becomes excessively large, which makes it difficult to realize a high density layout.

(3) The number of printing lines cannot be flexibly increased. If the layout of PTL 1 (FIG. 1 and FIG. 2 in PTL 1) were expanded and the number of lines were increased, the positions of the input units and the output units would lack unity and the input units and the output units would be further separated from one another. Some of the input units and the output units would be surrounded by apparatuses, and therefore a worker could not perform the work of carrying rolls from the pre-processing apparatus and the work of carrying rolls to the post-processing apparatus. In short, increasing the number of lines is practically impossible.

The present invention has been established in recognition of the above problems. An object of the present invention is to provide a printing system with which at least one of the above-described problems can be solved and to provide a sheet processing system that is not limited to performing printing.

SUMMARY OF INVENTION

An aspect of the present invention is a printing system capable of selectively performing duplex printing and simplex printing. The printing system includes a first printing apparatus, a second printing apparatus, a first input unit for introducing a sheet in a first direction, a second input unit for introducing a sheet in the first direction, the second input unit being provided near the first input unit, a first output unit to which a sheet that has been subjected to printing and that has traveled in a second direction, which is different from the first direction, is output, a second output unit to which a sheet that has been subjected to printing and that has traveled in the second direction is output, the second output unit being provided near the first output unit, and a changing unit that changes a traveling direction of a sheet from the first direction to the second direction.

In the duplex printing, the sheet supplied from the first input unit is subjected to printing on a first side of the sheet at the first printing apparatus and the traveling direction of the sheet is changed at the changing unit while the sheet is reversed, and then the sheet is subjected to printing on a second side of the sheet, which is the back of the first side, at the second printing apparatus and output to the second output unit. In the simplex printing, the sheet supplied from the first input unit is subjected to printing on one side of the sheet at the first printing apparatus and the traveling direction of the sheet is changed at the changing unit, and then the sheet is output to the first output unit, and/or the traveling direction of the sheet that has been supplied from the second input unit is changed at the changing unit and the sheet is subjected to printing on one side of the sheet at the second printing apparatus and output to the second output unit.

Further features of the present invention will become apparent from the following description of exemplary embodiments with reference to the attached drawings.

DESCRIPTION OF EMBODIMENTS

The present invention can be applied to a printing system that performs a printing process using a continuous sheet (or roll) of printing media. In addition, the present invention can be applied to a sheet processing system that performs not only the printing process but also various processes (recording, processing, coating, radiation, reading, inspection, etc.) on a continuous sheet and that is capable of performing a duplex process and a simplex process. An example in which the present invention is applied to a printing system including inkjet printing apparatuses will be described hereinafter. A "sheet" herein refers to a flexible and continuous sheet-like article made of any material such as paper, plastic, film, textile, metal, or a flexible substrate. In the following description, the term "continuous sheet" or simply the term "sheet" will be used. In addition, terms "roll of sheets" or simply "roll" is used to denote a round shape formed by a series of concentric circles formed by winding a continuous sheet or several sheets.

Figure 1:
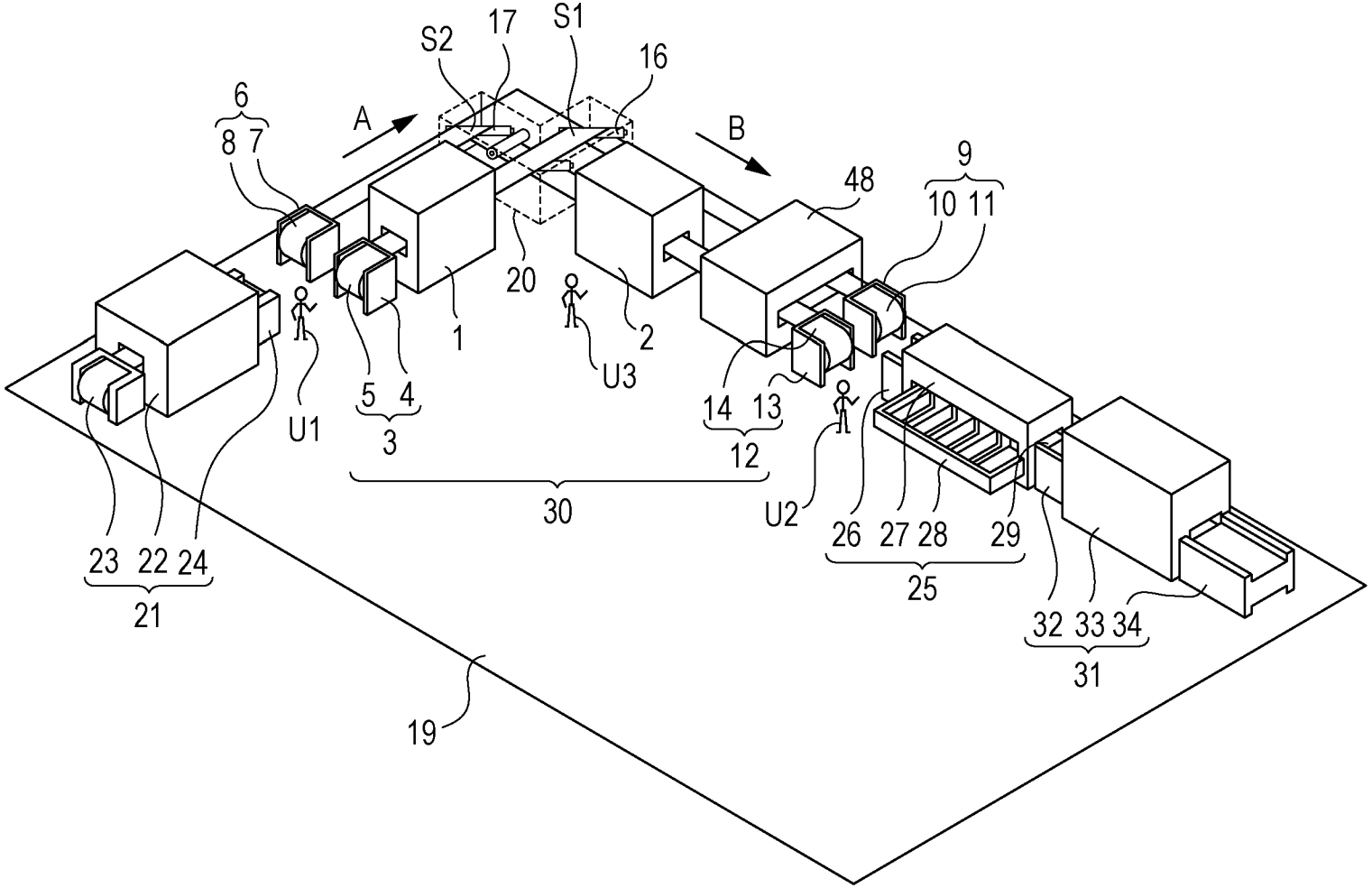
FIG. 1 is a general perspective view of a printing system according to an embodiment (simplex printing mode).

FIG. 1 is a general perspective view of a printing system according to an embodiment. In the figure, arrow A indicates a direction (first direction) in which a continuous sheet is introduced into a direction changing unit, and arrow B indicates a direction (second direction) in which the continuous sheet is discharged from the direction changing unit. Both the first direction and the second direction are directions along a plane that is parallel to the floor.

Processing devices to be used in an exemplary printing process are laid out on a floor 19 of a printing factory. The process includes a line formed of a printing system 30 that performs the printing process on a continuous sheet, a pre-processing apparatus for pre-processing of a printing step, and post-processing apparatuses for post-processing of the printing step. Printing apparatuses according to this embodiment use a roll of a continuous sheet and can selectively perform duplex printing or simplex printing. Duplex printing is defined as printing on a first side and a second side, which is the back of the first side, of the sheet; and simplex printing is defined as printing on one side of the sheet.

The core of the printing system 30 is made up of two printing apparatuses, namely a first printing apparatus 1 (first processing apparatus) and a second printing apparatus 2 (second processing apparatus), and a drying apparatus 48. Both the first printing apparatus 1 and the second printing apparatus 2 perform printing on one side (upper surface in FIG. 1) of a sheet. As a printing method, the printing apparatuses adopt an inkjet method, which may be a method using a heating element, a method using a piezoelectric element, a method using an electrostatic element, a method using a MEMS element, or the like. It is to be noted that the present invention is not limited to the inkjet method and can be applied to printing apparatuses adopting various printing methods, such as an electrophotographic printer, a thermal printer (dye-sublimation type, thermal transfer type, etc.), a dot impact printer, and a liquid development type printer.

The printing system 30 performs parallel processing using two lines. Therefore, carrying in (input) and carrying out (output) of rolls are also performed using two lines. With respect to carrying in, two lines formed of a first input unit 3 and a second input unit 6 are included. The first input unit 3 is used to introduce a first continuous sheet S1 in the first direction and supply the first continuous sheet S1 to the first printing apparatus 1. The second input unit 6 is used to introduce a second continuous sheet S2 similarly in the first direction and supply the second continuous sheet S2 to the second printing apparatus 2. The second input unit 6 is provided near and adjacent to the first input unit 3. In the first input unit 3, an unused roll 5, which is a roll of a continuous sheet of printing media, is set in a sheet holder 4, and the roll 5 rotates so that the sheet is introduced along a path. In the second input unit 6, an unused roll 8, which is a roll of a continuous sheet, is set in a sheet holder 7, and the roll 8 rotates so that the sheet is introduced along a path. It is to be noted that the sheet is not limited to one wound as a roll so long as the sheet is a continuous sheet. For example, a continuous sheet that is perforated at unit intervals, layered by folding the sheet at the perforations, and received by a sheet holder may be used.

Although the first input unit 3 and the second input unit 6 both introduce sheets in the first direction, the two are not necessarily strictly parallel to each other and a slight angular difference therebetween in the direction is allowed. In addition, the arrangement is not limited to one in which the positions of the first input unit 3 and the second input unit 6 are the same in terms of the first direction, that is, one in which the first input unit 3 and the second input unit 6 are adjacent to each other. So long as the direction in which the sheets are introduced is the first direction, the layout may be one in which the first input unit 3 and the second input unit 6 are arranged close to each other with a difference in the arrangement position provided between the first input unit 3 and the second input unit 6 in terms of the first direction.

With respect to carrying out, two lines in which a first output unit 9 and a second output unit 12 are formed are included. A continuous sheet that has been subjected to printing in the first printing apparatus 1 and has traveled in the second direction is output to the first output unit 9. A continuous sheet that has been subjected to printing in the second printing apparatus 2 and has similarly traveled in the second direction is output to the second output unit 12. The second output unit 12 is provided near and adjacent to the first output unit 9. In the first output unit 9, a continuous sheet that has been subjected to printing is wound onto a sheet holder 10 (winder) and output as a roll 11. In the second output unit 12, a continuous sheet that has been subjected to printing is wound onto a sheet holder 13 (winder) and output as a roll 14.

It is to be noted that although sheets are output to the first output unit 9 and the second output unit 12 in the second direction, the two are not necessarily strictly parallel to each other and a slight difference in the direction is allowed. In addition, the arrangement is not limited to one in which the positions of the first output unit 9 and the second output unit 12 are the same in terms of the second direction, that is, one in which the first output unit 9 and the second output unit 12 are adjacent to each other. The layout may be one in which the first output unit 9 and the second output unit 12 are arranged close to each other with a difference in the arrangement position in terms of the second direction provided between the first output unit 9 and the second output unit 12. Furthermore, the layout may be one in which the two input units are arranged close to each other but the two output units are not arranged close to each other and sheets are output in different directions, or one in which the two output units are arranged close to each other but the two input unit are not arranged close to each other and sheets are introduced in different directions. The present invention widely covers these embodiments.

The drying apparatus 48 dries a continuous sheet between the second printing apparatus 2 and the second output unit 12 before the continuous sheet is output to the second output unit 12. Furthermore, the same drying apparatus 48 also dries a continuous sheet before the continuous sheet is output to the first output unit 9. That is, the drying apparatus 48 is commonly provided for the two lines.

A direction changing unit 20 is a unit for, in the respective paths of the two lines, changing the traveling direction of continuous sheets from the first direction to the second direction, as well as reversing the continuous sheets. The direction changing unit 20 serves as a sheet direction changing apparatus for changing a direction of the continuous sheets in the two lines.

Figure 2A:
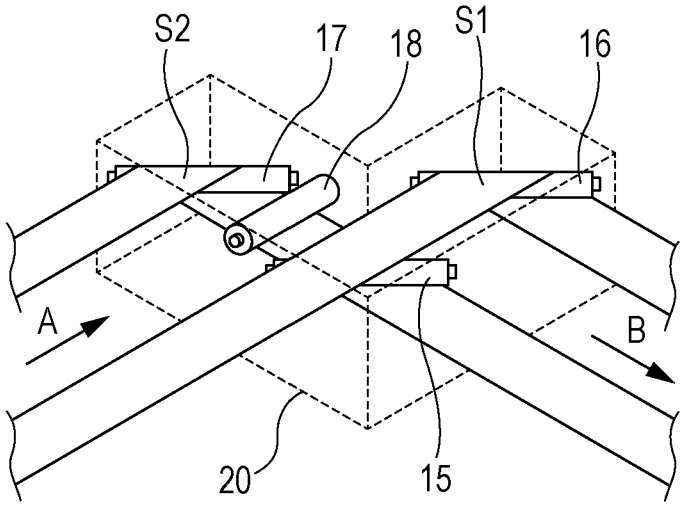
FIGS. 2A and 2B are enlarged views of a direction changing unit of FIG. 1.
Figure 2B:
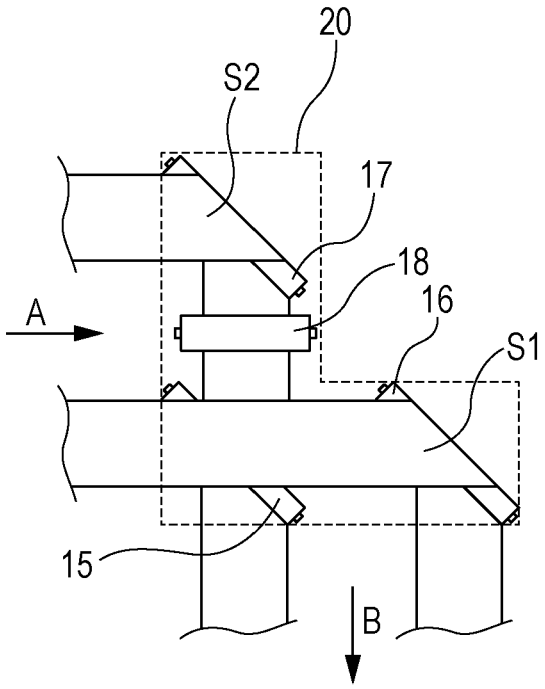

FIGS. 2A and 2B are enlarged views of the direction changing unit 20. FIG. 2A is a perspective view and FIG. 2B is a plan view. The direction changing unit 20 has a first turn bar 15, a second turn bar 16, and a third turn bar 17 as the basic configuration thereof. These turn bars 15, 16 and 17 are all driven rollers having rotation shafts that are inclined at approximately 45 degrees relative to the first direction. During the printing process, each of the turn bars 16 and 17 operates such that introduced sheets are obliquely wound thereonto by half a turn and then turned around, thus changing the traveling direction of the sheets by 90 degrees from the first direction (arrow A) to the second direction (arrow B). It is to be noted that the angles mentioned here are central values that allow certain errors to be included. It is also to be noted that the angle between the first direction and the second direction may be a certain angle other than 90 degrees and, in that case, the inclined angle of the rotation shaft of each turn bar may be half the certain angle. That is, with respect to the relationships between the three turn bars, the first turn bar 15 has a rotation shaft inclined at a certain angle relative to the first direction, the second turn bar 16 is arranged at a position further away than the first turn bar 15 when viewed from the first direction and has a rotation shaft inclined at the certain angle relative to the first direction, and the third turn bar 17 is arranged next to the first turn bar 15 when viewed from the first direction and has a rotation shaft inclined at the certain angle relative to the first direction. The direction changing unit 20 may incorporate all of the turn bars as a unit, or may be arranged so that separate units divided for each turn bar are located in accordance with the positional relationships described above.

In a duplex printing mode that will be described later, the first turn bar 15 operates in such a way that a continuous sheet that has been subjected to printing in the first printing apparatus 1 and is traveling in the first direction is obliquely wound thereonto and turned around, thereby changing the traveling direction of the continuous sheet to the second direction and causing the continuous sheet to travel to the second printing apparatus 2, while reversing the continuous sheet. In a simplex printing mode that will be described later, the second turn bar 16 operates in such a way that a continuous sheet that has been subjected to printing in the first printing apparatus 1 and is traveling in the first direction is obliquely wound thereonto and turned around, thereby changing the traveling direction of the continuous sheet to the second direction and causing the continuous sheet to travel to the first output unit 9, while reversing the continuous sheet. In a similar manner, the third turn bar 17 operates in such a way that a continuous sheet that has been introduced from the second input unit 6 and is traveling in the first direction is obliquely wound thereonto and turned around, thereby changing the traveling direction of the continuous sheet to the second direction and causing the continuous sheet to travel to the second printing apparatus 2, while reversing the continuous sheet. The direction changing unit 20 further includes a fourth turn bar 18, which will be described later.

The first turn bar 15, the second turn bar 16, the third turn bar 17, and the fourth turn bar 18 are contact turn bars, which turn sheets wound thereonto with the roller surfaces thereof that are in contact with the sheets. As another embodiment, a non-contact turn bar having a non-contact-type static pressure surface may be used for all or some of the turn bars. The non-contact-type static pressure surface supports a sheet without making contact with the sheet by making the sheet float at a minute height using air ejected therefrom. The static pressure surface may be formed of, for example, a porous body and ejects air from porous micropores to float a sheet using static pressure or using both static pressure and dynamic pressure. In the direction changing unit 20, a non-contact turn bar is fixed or rotatably supported. A non-contact turn bar does not necessarily rotate and therefore need not have a roller shape if at least a portion that faces a sheet (a portion that supports a sheet without making contact with the sheet) is a static pressure surface that has a certain curvature. Regardless of whether a turn bar is of the contact type or the non-contact type, the turn bar invariably operates in such a way that a continuous sheet is wound onto the surface thereof and changes the direction.

Next, the pre-processing apparatus for pre-processing of the printing step and the post-processing apparatuses for post-processing of the printing step will be described. In FIG. 1, a pre-coating apparatus 21 is provided as the pre-processing apparatus upstream of the first input unit 3 and the second input unit 6 in the printing system 30. The pre-coating apparatus 21 includes a processing unit 22, and an input unit 23 and an output unit 24 provided before and after the processing unit 22, respectively. The pre-coating apparatus 21 performs a pre-coating process on one side or both sides of a sheet with the processing unit 22 before printing in order to improve the smoothness and the glossiness of the surface(s) of the sheet. A sheet that has been subjected to the pre-processing in the pre-coating apparatus 21 is output to the output unit 24 as a roll. The roll is carried by a worker U1 to either the first input unit 3 or the second input unit 6. The first input unit 3 and the second input unit 6 are adjacent to each other and the distances thereof to the pre-coating apparatus 21 are short. Regardless of which input unit a roll is carried to, the distance from the pre-coating apparatus 21 can be small. Since a workspace in which the worker U1 works to feed a sheet to the printing system 30 is concentrated in one place, the total floor area can be small and the workability of the worker U1 is high. In addition, since a distance over which the worker U1 carries a roll from the pre-coating apparatus 21 to either the first input unit 3 or the second input unit 6 is short, the workload of the worker U1 can be small. Furthermore, because a direction in which a roll is mounted is the same for the first input unit 3 and the second input unit 6, regardless of which input unit the worker U1 should mount a roll in, he/she will not become confused.

A sheet cutting apparatus 25 and a bookbinding apparatus 31 that is located downstream of the sheet cutting apparatus 25 are provided downstream of the first output unit 9 and the second output unit 12 in the printing system 30 as the post-processing apparatuses. The sheet cutting apparatus 25 includes an input unit 26, a cutter unit 27, a discharge tray unit 28, and an output unit 29. The roll 11 in the first output unit 9 and the roll 14 in the second output unit 12 are carried by a worker to the input unit 26 of the sheet cutting apparatus 25. A roll subjected to printing is cut into a certain unit length by the cutter unit 27 and discharged into a plurality of trays of the discharge tray unit 28 by lot. The sheet cut by the cutter unit 27 may be further conveyed to the bookbinding apparatus 31 located further downstream of the output unit 29 and subjected to a bookbinding process. The bookbinding apparatus 31 performs a folding process, a binding process, and the like. The bookbinding apparatus 31 includes an input unit 32, a processing unit 33, and an output unit 34. A cut sheet output from the output unit 29 of the sheet cutting apparatus 25 is conveyed to the input unit 32 of the bookbinding apparatus 31 and subjected to processes such as folding and binding in the processing unit 33. A finished product is then output to the output unit 34.

Rolls output to the first output unit 9 and the second output unit 12 of the printing system 30 are carried to the sheet cutting apparatus 25 by a worker U2. Here, the first output unit 9 and the second output unit 12 are adjacent to each other and the distances thereof to the sheet cutting apparatus 25 are short. Regardless of which output unit a roll is carried from, the distance to the sheet cutting apparatus 25 is short. Since a workspace in which the worker U2 works to carry a sheet from the printing system 30 is concentrated in one place, the total floor area can be small and the workability of the worker U2 is high. In addition, since a distance over which the worker U2 carries a roll from either the first output unit 9 or the second output unit 12 to the sheet cutting apparatus 25 is short, the workload of the worker U2 can be small. Furthermore, because a direction in which a roll is held is the same for the first output unit 9 and the second output unit 12, regardless of which output unit the worker U2 should remove a roll from, he/she will not be confused. It is to be noted that the pre-processing apparatus and the post-processing apparatuses are not limited to the above examples and may be processing apparatuses of any type.

As described above, the printing system 30 has an inverted L-shape layout in which the paths are bent halfway by the direction changing unit 20. The pre-processing apparatus is arranged on a line extending in the first direction and the post-processing apparatuses are arranged on a line extending in the second direction. The layout still has an inverted L-shape when viewed as a whole in the order of print processing. By arranging the two lines of the inverted L-shape along two lines of a rectangular floor 19, dead space can be reduced and the lines can be arranged densely with a smaller floor area. For example, in the printing system 30, if the distances from the two input units to the direction changing unit 20 are assumed to be 10 m and the distances from the direction changing unit 20 to the two output units are assumed to be 15 m, the printing system 30 is arranged in a corner of a floor having an area of 10 m×15 m, thereby providing extra space in the inward side of the inverted L-shape. Furthermore, even if, for example, line lengths of 5 m and 15 m are required for the pre-processing apparatus and the post-processing apparatuses, respectively, the entire system can be arranged in the corner of the floor having an area of 15 m×30 m, which provides even more extra space.

In addition, the first printing apparatus 1 is provided on an inward one of the two lines that extend along the first direction from the first input unit 3 and the second input unit 6 to the direction changing unit 20 and that are parallel to each other. That is, the first printing apparatus 1 is provided on an inward line of a pair of substantially parallel lines that extends from the first input unit 3 and the second input unit 6 to the changing unit 20. The second printing apparatus 2 is provided on an inward one of the two lines that extend along the second direction from the direction changing unit 20 to the first output unit 9 and the second output unit 12 and that are parallel to each other. In other words, the second printing apparatus 2 is provided on an inward line of a pair of substantially parallel lines that extends from the changing unit 20 to the first output unit 9 and the second output unit 12. As a result, both the first printing apparatus 1 and the second printing apparatus 2 are provided on the inward one of the two parallel lines that are bent halfway by approximately 90 degrees. Expressed in another way, the pair of substantially parallel lines that extends from the first input unit 3 and the second input unit 6 to the changing unit 20 is substantially orthogonal to the pair of substantially parallel lines that extends from the changing unit 20 to the first output unit 9 and the second output unit 12, and the first printing apparatus 1 and the second printing apparatus 2 are respectively placed on an inward line of these pairs of lines. When either the first printing apparatus 1 or the second printing apparatus 2 needs to be maintained in the case of regular maintenance, occurrence of trouble during the operation of the apparatuses, or the like, a worker U3 can access each apparatus from the inward side of the lines. It is easy for the worker U3 to access any apparatus, which increases the work efficiency during maintenance.

Figure 10:
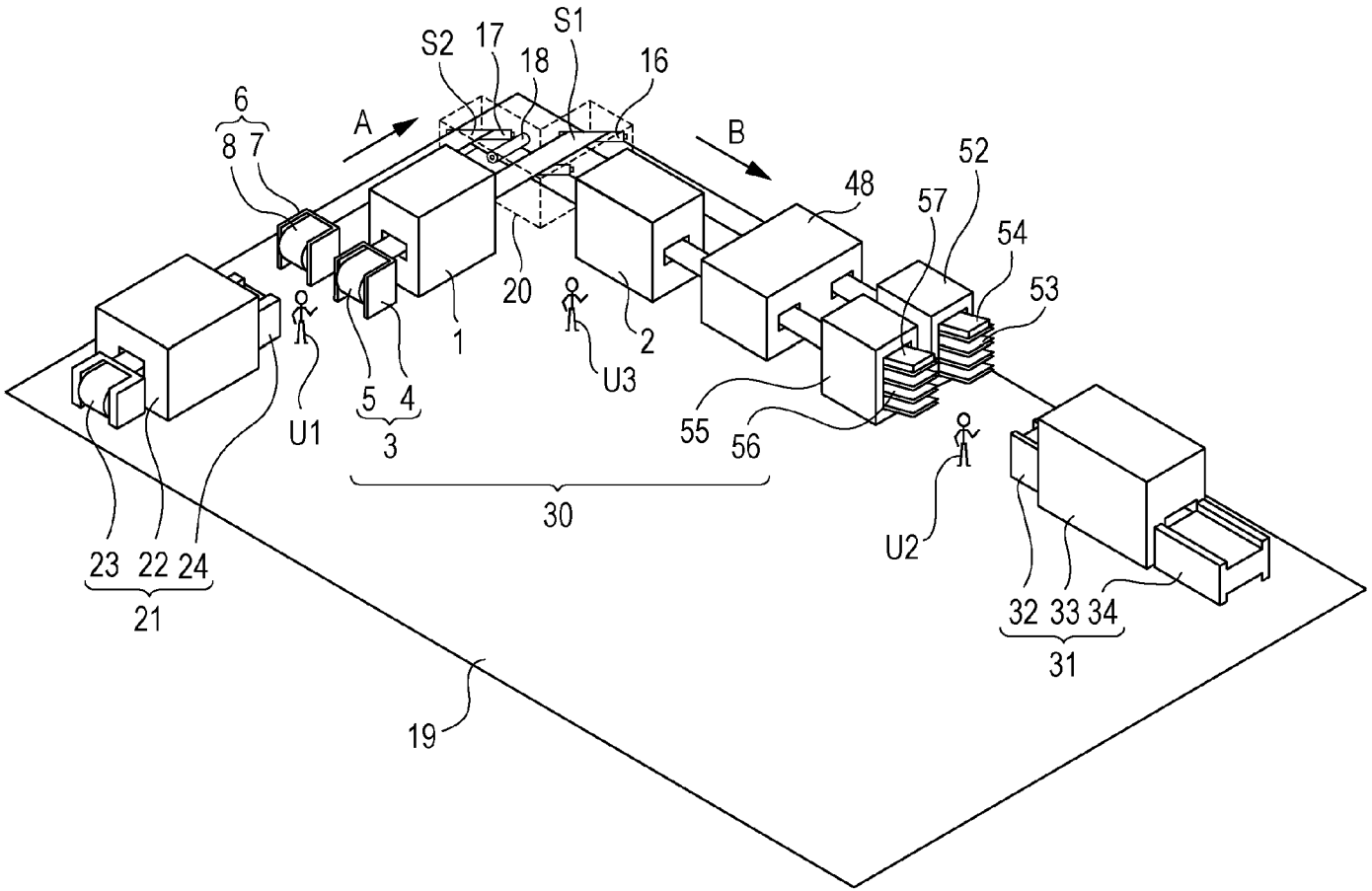
FIG. 10 is a general perspective view of a modification of FIG. 1.

FIG. 10 is a general perspective view of a modification of FIG. 1. Compared to the configuration illustrated in FIG. 1, the modification is different in that cutter units (a first cutter unit 52 and a second cutter unit 55) that cut continuous sheets and output units (a first output unit 53 and a second output unit 56) that are integrated with the cutter units are incorporated into the two lines. The first output unit 53 and the second output unit 56 are sorting apparatuses having multistage trays. Continuous sheets are cut by the first cutter unit 52 and the second cutter unit 55 into a certain length and output to the trays of the first output unit 53 and the second output unit 56 as sheet stacks (a sheet stack 54 and a sheet stack 57) one by one. Thus, the modification is characterized in that the first cutter unit 52 and the second cutter unit 55 for cutting continuous sheets into a certain length before the continuous sheets subjected to printing are output to the first output unit 53 and the second output unit 56 are incorporated into the lines. Therefore, a sheet cutting apparatus is not necessary as a post-processing apparatus. The sheet stacks 54 and 57 in the first output unit 53 and the second output unit 56 are carried by the worker U2 to the bookbinding apparatus 31, which is a post-processing apparatus. Since the first output unit 53 and the second output unit 56 are concentrated in one place, the workload of the worker U2 can be minimized.

Figure 11:
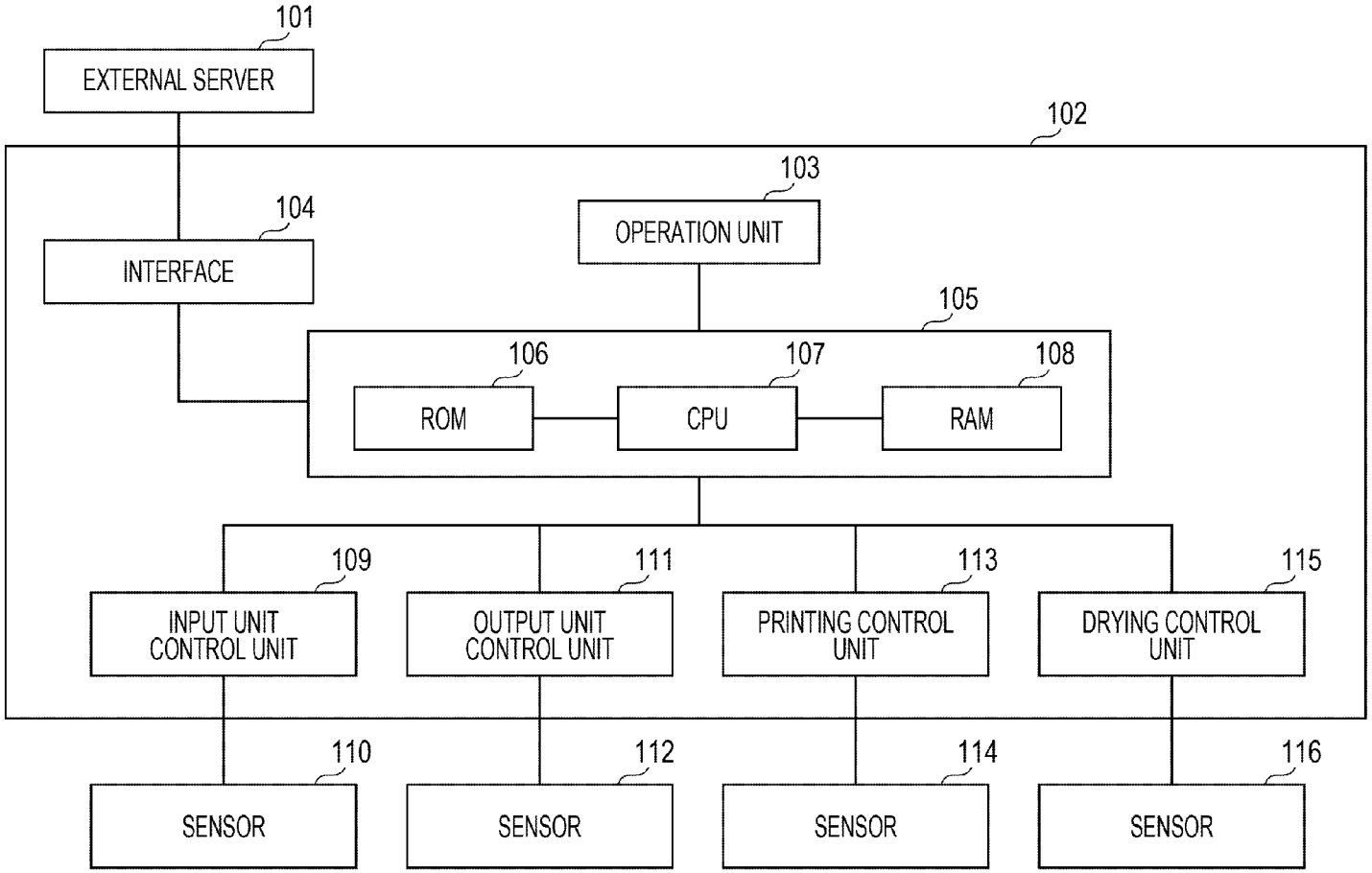
FIG. 11 is a block diagram of a control unit of the printing system.

FIG. 11 illustrates a block diagram of the control system of the printing system 30. A control apparatus 102 takes charge of the operation control of the first printing apparatus 1 and the second printing apparatus 2. The control apparatus 102 includes an operation unit 103, an interface 104, and a controller 105, and the controller 105 is formed of a CPU 107, a ROM 106, and a RAM 108. The operation unit 103 has keys and buttons for allowing a worker to input information thereto and a display for displaying the information for the worker. The controller 105 is connected to an external server 101 through the interface 104. The external server 101 may be a computer that, for example, creates or processes image data to be printed, or a dedicated image input device of an image reader, a digital camera, a photo storage, or the like. The control apparatus 102 further includes dedicated control units that control the units forming the printing system 30. The dedicated control units may include an input unit control unit 109, an output unit control unit 111, a printing control unit 113, and a drying control unit 115. If the configuration illustrated in FIG. 10 is adopted, the dedicated control units further include a cutter control unit. The signals of various sensors 110 such as those of encoders of the first input unit 3 and the second input unit 6 are input to the input unit control unit 109. The signals of various sensors 112 such as those of encoders of the first output unit 9 and the second output unit 12 are input to the output unit control unit 111. The signals of various sensors 114 of the first printing apparatus 1 and the second printing apparatus 2 are input to the printing control unit 113. The signals of various sensors of the drying apparatus 48 are input to the drying control unit 115. These dedicated control units are provided with instructions by the controller 105 so that the entire system can be controlled.

Next, the operation of the printing system 30 in the duplex printing mode (first mode) and the simplex printing mode (second mode) will be described. The worker selects either mode with the operation unit 103 and starts printing after setting sheets as described below.

<Simplex Printing Mode>

First, the simplex printing mode will be described. FIGS. 1, 2A, and 2B illustrate a situation in which sheets are conveyed in the simplex printing mode. In the simplex printing mode, both the first printing apparatus 1 and the second printing apparatus 2 are operated in parallel with each other or either the first printing apparatus 1 or the second printing apparatus 2 is operated. When the first printing apparatus 1 is operated, a continuous sheet supplied from the first input unit 3 is subjected to simplex printing in the first printing apparatus 1 and changes the traveling direction thereof in the direction changing unit 20, and then output to the first output unit 9 through the drying apparatus 48. When the second printing apparatus 2 is operated, a continuous sheet supplied from the second input unit 6 changes the direction thereof in the traveling direction changing unit 20 and is subjected to simplex printing in the second printing apparatus 2, and then output to the second output unit 12 through the drying apparatus 48. Before entering the simplex printing mode, a worker sets the sheets of the two lines in such paths and starts printing.

FIGS. 2A and 2B illustrate the state of sheets passing through the direction changing unit 20 when both the first printing apparatus 1 and the second printing apparatus 2 are operated in parallel with each other. The sheets of the two lines cross in the direction changing unit 20 at different heights and therefore the sheets do not come into contact with each other. More specifically, the first continuous sheets S1 that has been introduced from the first input unit 3 and subjected to printing in the first printing apparatus 1 passes over the first turn bar 15 and is obliquely wound onto the second turn bar 16 by half a turn from the top to the bottom of the second turn bar 16. The traveling direction of the continuous sheet S1 is then changed from the first direction to the second direction as the continuous sheet S1 travels. On the other hand, the second continuous sheet S2 introduced from the second input unit 6 is obliquely wound onto the third turn bar 17 by half a turn from the top to the bottom of the third turn bar 17. The traveling direction of the second continuous sheet S2 is then changed from the first direction to the second direction and the continuous sheet S2 travels and passes under the fourth turn bar 18 and the first turn bar 15. That is, since the continuous sheet S1 and the continuous sheet S2 are vertically separated at the position of the first turn bar 15 and accordingly cross at different heights, the sheets are prevented from coming into contact with each other in the apparatus.

By passing the sheets like this, when the continuous sheet S1 whose first side (upper surface in FIGS. 2A and 2B) has been subjected to printing in the first printing apparatus 1 is wound onto the second turn bar 16, the second side thereof, which is a surface that has not been subjected to printing, faces the surface of the second turn bar 16. The printed first side does not face the surface of the second turn bar 16 nor the surface of any other turn bar. When the continuous sheet S1 passes through the direction changing unit 20, the ink thereon has not been sufficiently dried because the continuous sheet S1 has just been subjected to printing in the first printing apparatus 1 and has not passed through the drying apparatus 48. If the printed surface comes into contact with any turn bar in this condition, dust may adhere to the printed surface from the turn bar or the ink thereon may be transferred onto the turn bar, thereby causing the printed image to be adversely affected. Even if the above-described non-contact turn bar is used and the printed surface does not face the surface of any turn bar, when air is ejected from the surface of a turn bar to the printed surface immediately after printing, the drying condition may change and irregularity in color may be caused. By passing the sheets as in this embodiment, since the printed surface does not face the surface of any turn bar, the printed image can be prevented from being adversely affected due to a sheet that comes into contact with the surface of the turn bar or air ejected from a static pressure surface. With respect to the continuous sheet S2, the continuous sheet S2 is subjected to printing in the second printing apparatus 2 after passing through the direction changing unit 20. Because a surface to be subjected to printing does not come into contact with anything, the surface to be subjected to be printing can be prevented from being scratched or collecting dust before printing.

<Duplex Printing Mode>

Figure 3:
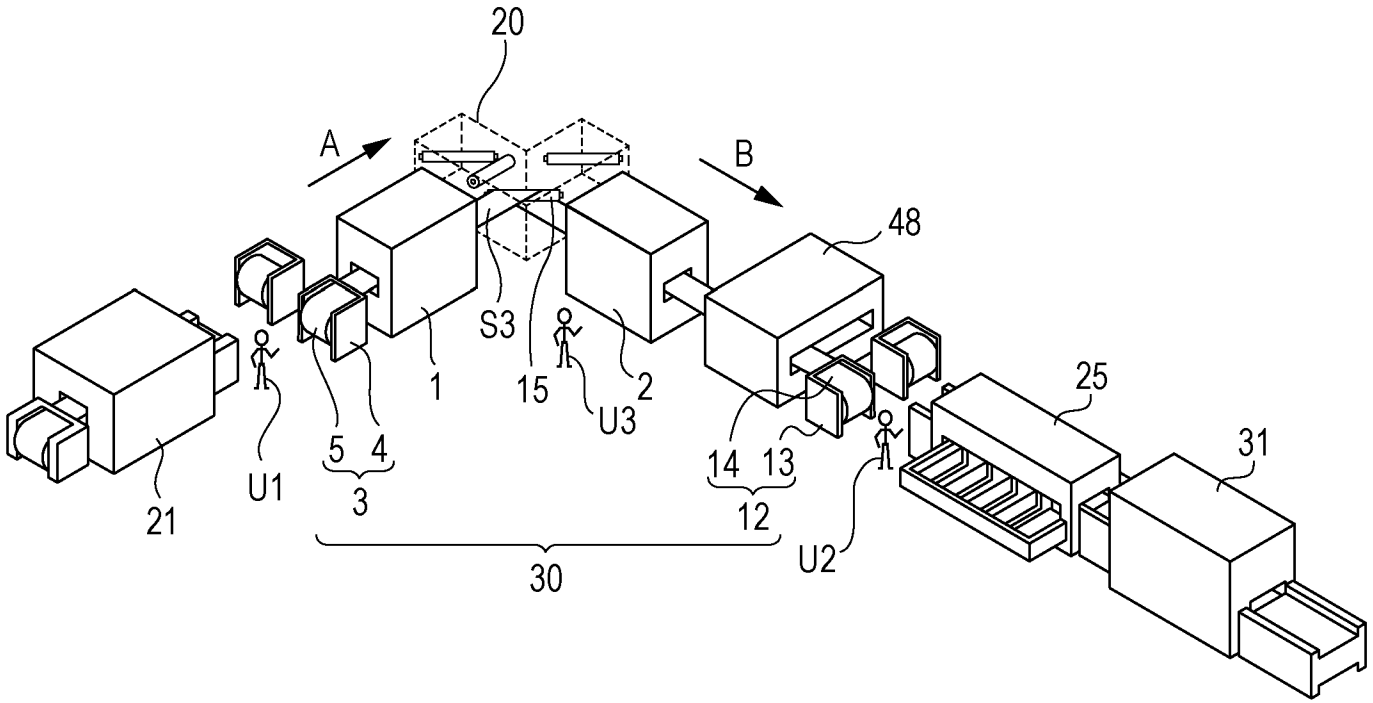
FIG. 3 is a general perspective view of the printing system (duplex printing mode).
Figure 4A:
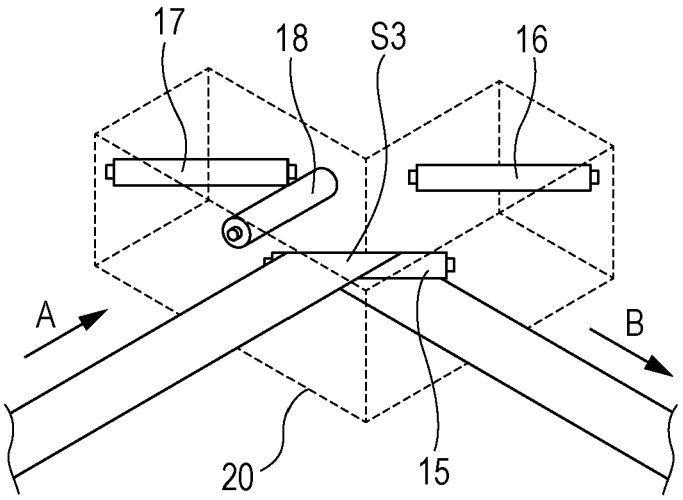
FIGS. 4A and 4B are enlarged views of the direction changing unit of FIG. 3.
Figure 4B:
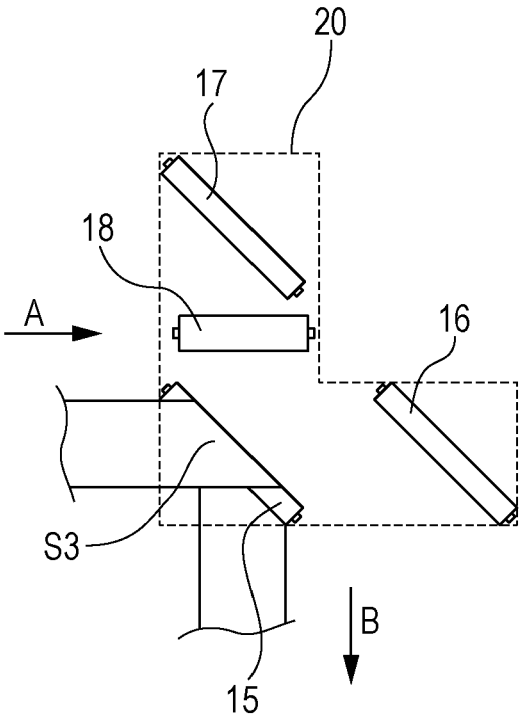

Next, the duplex printing mode will be described. FIGS. 3, 4A, and 4B illustrate a situation in which sheets are conveyed in the duplex printing mode. FIGS. 4A and 4B are enlarged views illustrating a situation in which the sheets pass through the direction changing unit of FIG. 3. FIG. 4A is a perspective view and FIG. 4B is a plan view.

In the duplex printing mode, the first printing apparatus 1 and the second printing apparatus 2 are used in series and both sides of a sheet are sequentially subjected to printing. More specifically, a continuous sheet supplied from the first input unit 3 is subjected to printing on the first side thereof in the first printing apparatus 1 and the traveling direction thereof is changed in the direction changing unit 20, while being reversed. The second side of the sheet is then subjected to printing in the second printing apparatus 2 and the continuous sheet is output to the second output unit 12 through the drying apparatus 48. The second input unit 6 and the first output unit 9 are not used in the duplex printing mode. The worker sets a sheet in such a path before entering the duplex printing mode, and starts printing.

In FIGS. 4A and 4B, a continuous sheet S3 that has been introduced from the first input unit 3 and subjected to printing in the first printing apparatus 1 is obliquely wound onto the first turn bar 15 by half a turn from the top to the bottom of the first turn bar 15. The traveling direction of the continuous sheet S3 is then changed from the first direction to the second direction as the continuous sheet S3 travels to the second printing apparatus 2. By passing the sheet like this, when the continuous sheet S3 whose first side (upper surface in FIGS. 4A and 4B) has been subjected to printing in the first printing apparatus 1 is wound onto the first turn bar 15, the second side thereof, which is a surface that has not been subjected to printing, faces the surface of the first turn bar 15. Since the printed first side does not face the surface of the first turn bar 15 nor the surface of any other turn bar, the printed image is prevented from being adversely affected.

<Two-Time Simplex-Printing Mode>

The printing system 30 is configured to be capable of executing not only the simplex printing mode and the duplex printing mode, which have been described above, but also a two-time simplex-printing mode. In addition, the above-described simplex printing mode (one-time simplex-printing mode) can be executed in the same apparatus configuration. The worker selects any of the modes using the operation unit 103 and sets a sheet as described below before starting printing.

Figure 5:
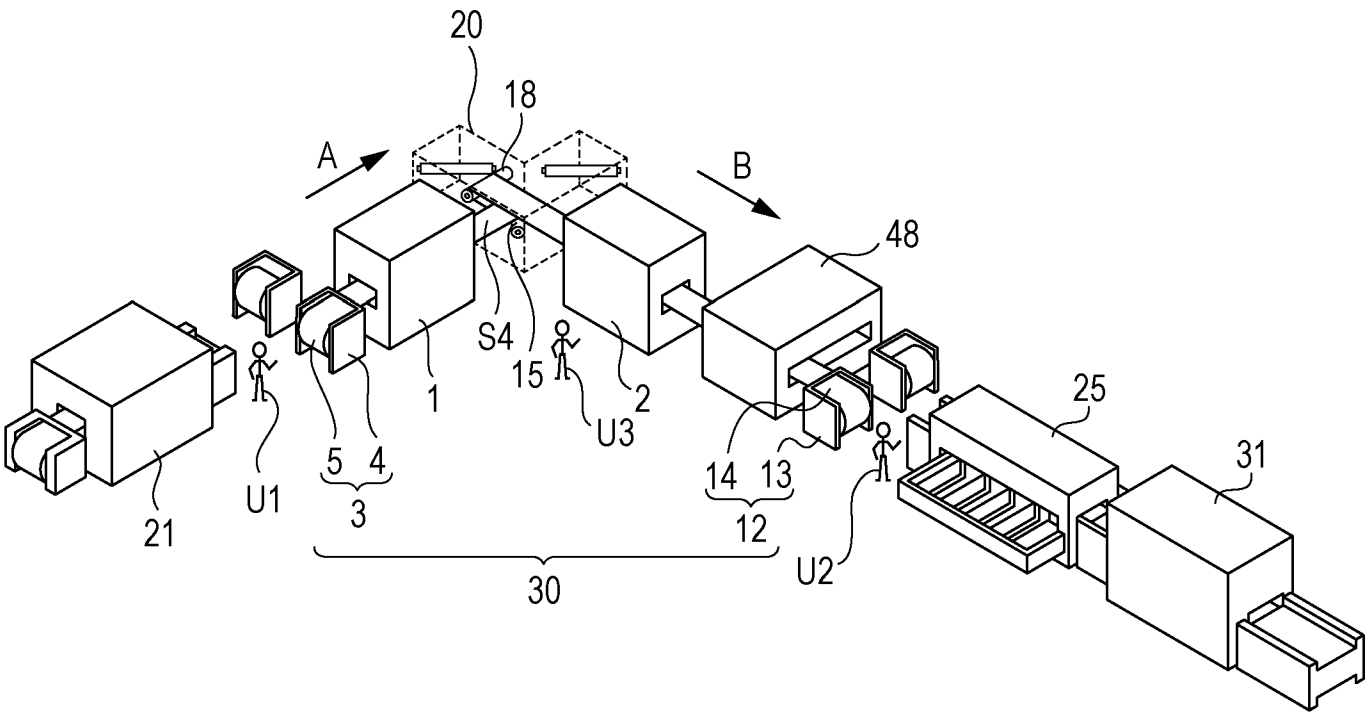
FIG. 5 is a general perspective view of the printing system (two-time simplex-printing mode).
Figure 6A:
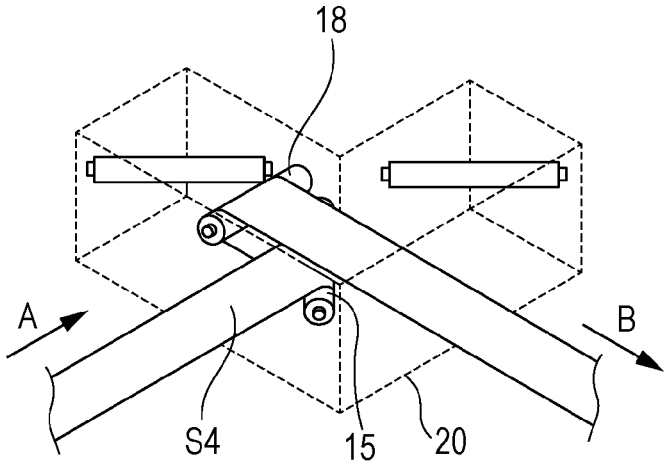
FIGS. 6A and 6B are enlarged views of the direction changing unit of FIG. 5.
Figure 6B:
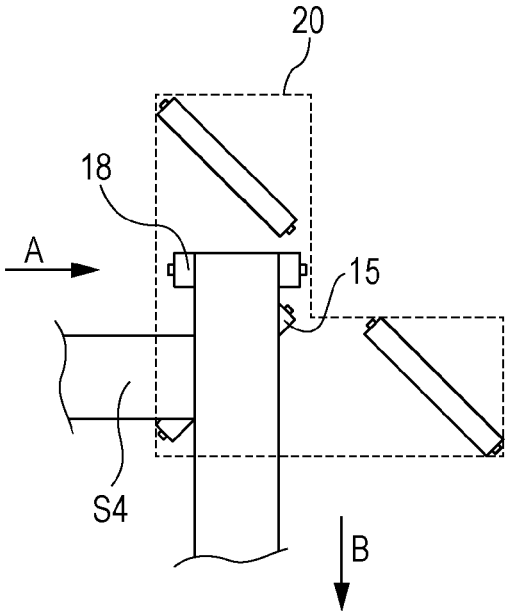

FIGS. 5, 6A, and 6B illustrate a situation in which a sheet is conveyed in the two-time simplex-printing mode. In the two-time simplex-printing mode, the first printing apparatus 1 and the second printing apparatus 2 are used in series and the same side (first side) of the sheet is sequentially subjected to printing. More specifically, a continuous sheet supplied from the first input unit 3 is subjected to printing on the first side in the first printing apparatus 1 and the traveling direction thereof is changed in the direction changing unit 20 without being reversed. The continuous sheet is then subjected to printing on the first side again in the second printing apparatus 2 and output to the second output unit 12 through the drying apparatus 48.

In FIGS. 6A and 6B, the first turn bar 15 has a rotation shaft whose direction is different from that in the example of FIGS. 4A and 4B. The shaft direction is reversely inclined by 45 degrees (−45 degrees) relative to the first direction, in which a sheet is introduced. Thus, the first turn bar 15 has a switching mechanism that is capable of rotating 90 degrees, so that the turning direction thereof can be set to one in FIGS. 4A and 4B or one in FIGS. 6A and 6B. It is to be noted that the angles mentioned here are central values that allow certain errors to be included. Either the duplex printing mode or the two-time simplex-printing mode can be selected by the rotation of the first turn bar 15 enabled by the switching mechanism.

A continuous sheet S4 that has been introduced from the first input unit 3 and subjected to printing on the first side in the first printing apparatus 1 is obliquely wound onto the first turn bar 15 by half a turn from the top to the bottom of the first turn bar 15 and changes the traveling direction thereof to a direction that is 180 degrees opposite to the second direction. The sheet is then squarely wound onto the fourth turn bar 18 by half a turn from the bottom to the top of the fourth turn bar 18 and the traveling direction thereof is changed by 180 degrees. The sheet is oriented in the second direction and travels toward the second printing apparatus 2. Since the number of turns made by the turn bars is two (even number) and the sheet is reversed twice, the sheet is not reversed in the direction changing unit 20 as a result. The first side of the sheet is subjected to printing again in the second printing apparatus 2.

By passing the sheet like this, when the continuous sheet S4 whose first side (upper surface in FIGS. 6A and 6B) has been subjected to printing in the first printing apparatus 1 is wound onto the first turn bar 15, the second side thereof, which is a surface that has not been subjected to printing, faces the surface of the first turn bar 15. When the continuous sheet S4 is wound onto the subsequent fourth turn bar 18, too, the second side of the sheet faces the surface of the fourth turn bar 18. Since the printed first side does not face the surface of the first turn bar 15, the surface of the fourth turn bar 18, nor the surface of any other turn bar, the printed image is prevented from being adversely affected.

In the two-time simplex-printing mode, if the two printing apparatuses apply inks of different colors, the number of colors in total can be doubled while the printing speed is maintained, which further improves the image quality. In addition, if the surface to be printed of a sheet is subjected to minute space division and the two printing apparatuses perform synchronous printing for the respective associated spaces, the sheet conveying speed can be increased up to a speed that is twice as high, thereby improving the printing throughput.

The one-time simplex-printing mode is as described with reference to FIGS. 1, 2A, and 2B. Even if the first turn bar 15 is in the direction illustrated in FIGS. 6A and 6B, since the first turn bar 15 is not used in the one-time simplex-printing mode, operation is not affected.

<Line Addition>

Figure 7:
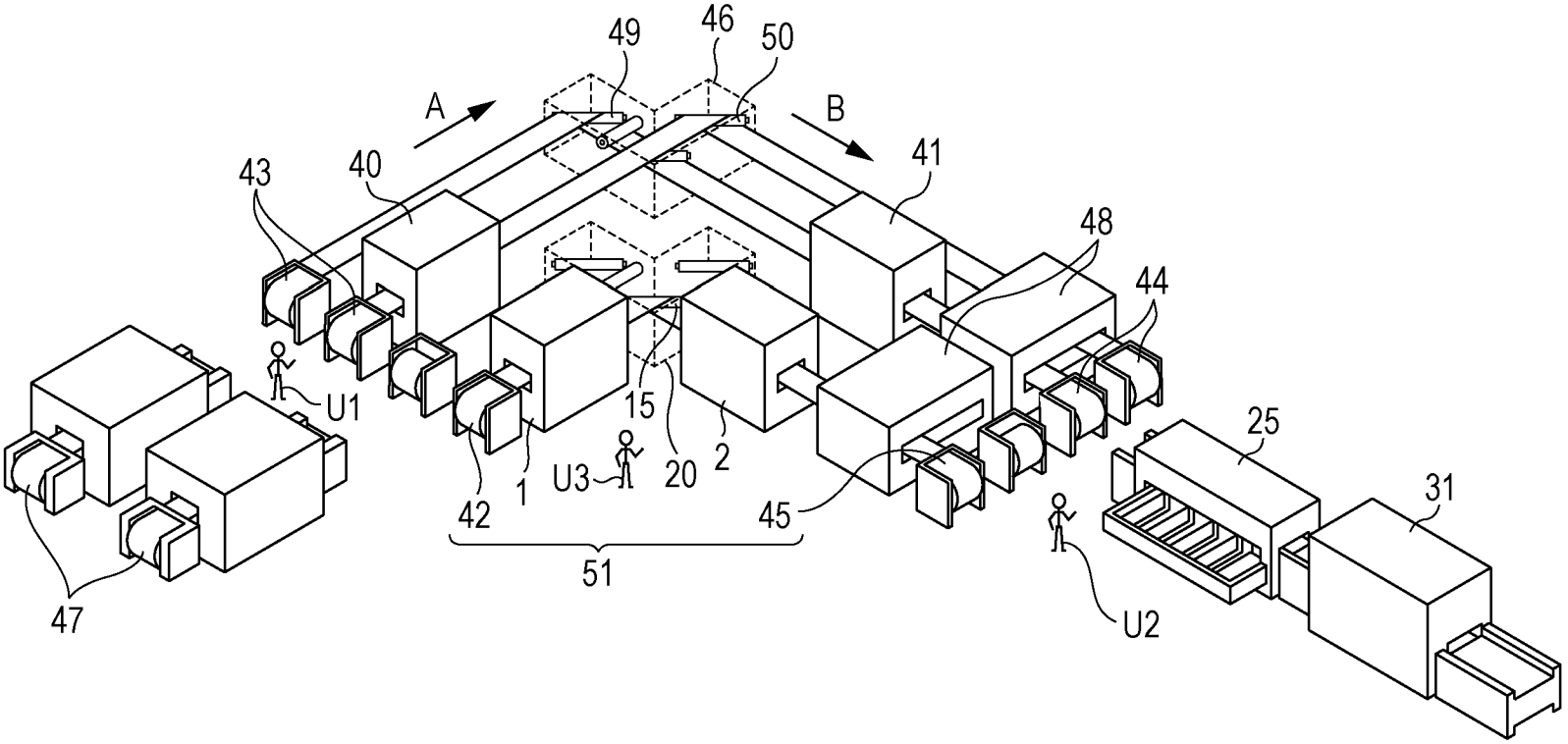
FIG. 7 is a general perspective view when the number of printing lines are increased.
Figure 8A:
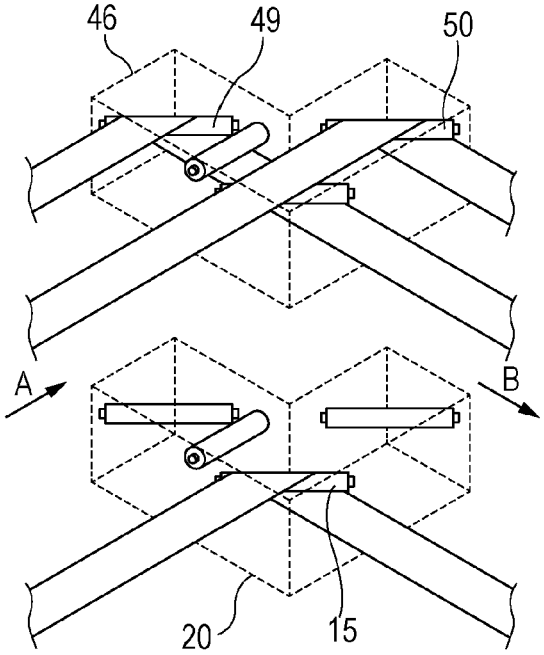
FIGS. 8A and 8B are enlarged views of the direction changing unit of FIG. 7.
Figure 8B:
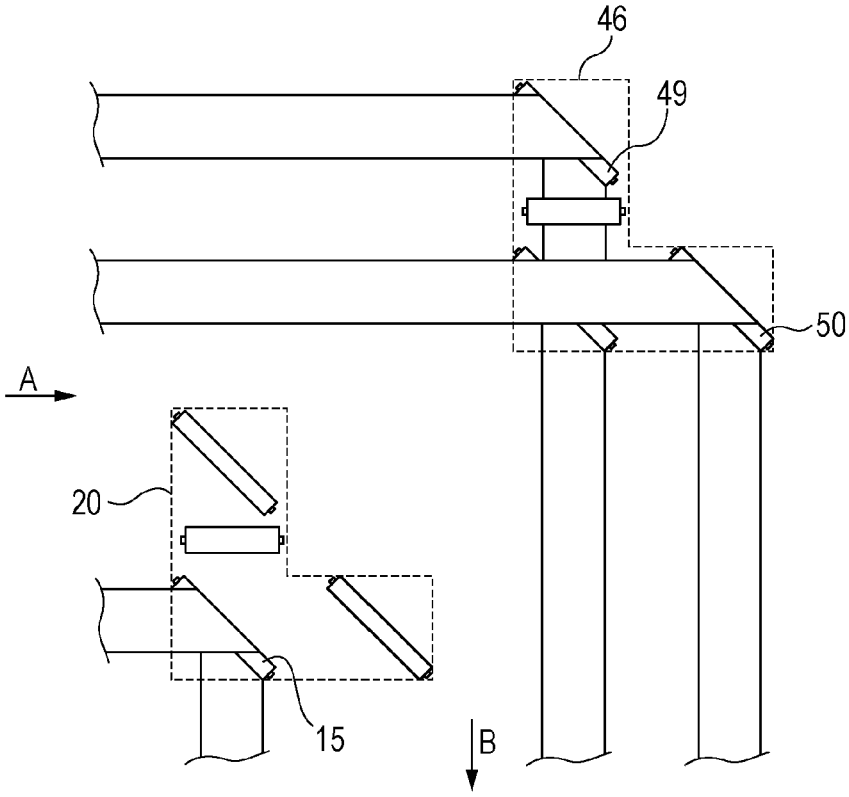

The number of printing lines can be easily increased with the printing system 30 as a unit. FIG. 7 is a perspective view illustrating the general configuration of the lines, the number of which has been increased. FIGS. 8A and 8B are enlarged views of direction changing units of FIG. 7. FIG. 8A is a perspective view and FIG. 8B is a plan view.

Figure 9:
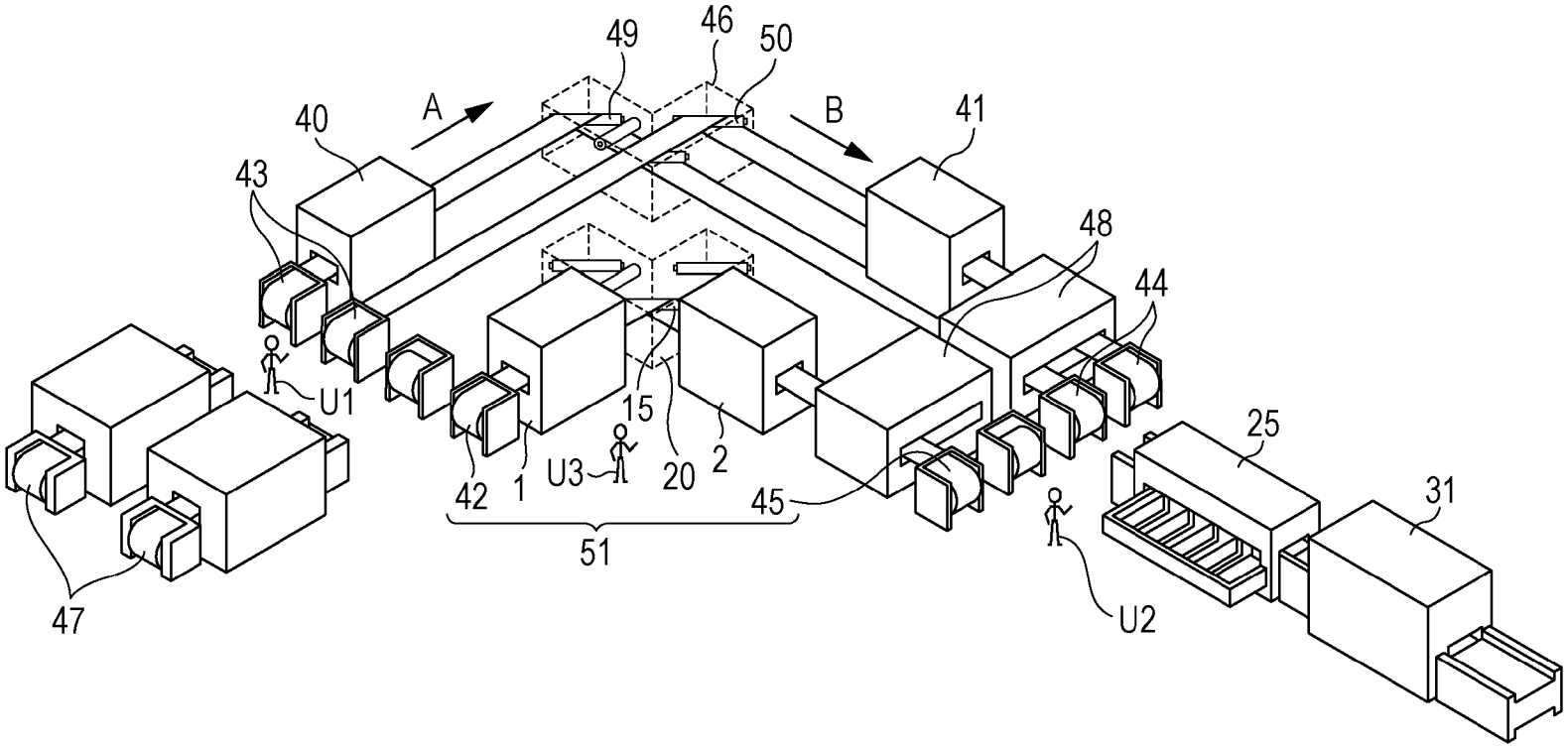
FIG. 9 is a general perspective view of a modification of FIG. 7.

The two lines that includes the first printing apparatus 1, the second printing apparatus 2, and the direction changing unit 20 are the same as those described above. The two lines may have a configuration as illustrated in FIG. 9. Similar two lines are added to the outward side of the above two lines and accordingly a printing system 51 as a whole has four lines in total by including two sets of two lines. The added lines are mainly formed of a third printing apparatus 40, a fourth printing apparatus 41, and a direction changing unit 46. The direction changing unit 46 contains a plurality of turn bars including a turn bar 49 having the same function as the turn bar 17, and a turn bar 50 having the same function as the turn bar 16. Two added input units 43 and two added output units 44 are included. The structure of the direction changing unit 46 is the same as that of the direction changing unit 20. Although two drying apparatuses 48 are provided, a drying apparatus may be provided for each line or a single drying apparatus may be commonly provided for the four lines. In addition, although two pre-coating apparatuses 47 are provided as pre-processing apparatuses, a single pre-coating apparatus or three or more pre-coating apparatuses may be provided instead.

In an example illustrated in FIGS. 8A and 8B, the duplex printing mode is executed in the direction changing unit 20 (two inward lines) and the one-time simplex-printing mode is executed in the direction changing unit 46 (two outward lines). The four printing apparatuses operate at the same time to perform one process of duplex printing and two processes of simplex printing at the same time. The combination of the duplex printing mode, the one-time simplex-printing mode, and the two-time simplex-printing mode is not limited to this and can be arbitrarily changed in accordance with the purpose of use of the worker.

As described above, the number of processing lines can be easily increased and the input units and the output units after the number of lines are increased are each concentrated in the same places. In the printing system 51 in which the number of lines has been increased, the four input units are adjacent to one another and concentrated in the same position, and the four output units are adjacent to one another and concentrated in the same position. That is, the workspace in which the worker U1 works to carry a sheet to the printing system 51 and the workspace in which the worker U2 works to carry a sheet from the printing system 51 are each concentrated in one place. Therefore, the total floor area can be small and the workability of the worker U1 and the worker U2 is high.

FIG. 9 illustrates the configuration of a modification of FIG. 7. The lines in which the third printing apparatus 40 and the fourth printing apparatus 41 are arranged are different from the layout of FIG. 7. That is, the third printing apparatus 40 and the fourth printing apparatus 41 are provided on the outermost line. The first printing apparatus 1 and the second printing apparatus 2 are provided on the innermost line. When either the first printing apparatus 1 or the second printing apparatus 2 needs to be maintained in the case of regular maintenance, occurrence of trouble during the operation of the apparatuses, or the like, the worker U3 can access each apparatus from the inward side of the four lines. In addition, when either the third printing apparatus 40 or the fourth printing apparatus 41 needs to be maintained, the worker U3 can access each apparatus from the outward side of the four lines by walking around the printing system 51 to the other side. It is easy to access any apparatus and the work efficiency during maintenance is high.

According to the above embodiment, the number of processing lines can be flexibly increased. Since the input units and the output units are each concentrated in the same place both in the case of the basic unit and in the case of increased lines, the distance over which a roll is carried from the pre-processing apparatus and the distance over which a roll is carried to the post-processing apparatus are short and the workloads of workers are small. In addition, the floor area in the factory required to arrange the processing lines is small, which realizes a high density layout. In addition, it is easy for a worker to access any apparatus and the maintenance properties are high. In addition, either in the duplex printing mode or in the simplex printing mode (one-time simplex-printing mode or two-time simplex-printing mode), when a sheet is turned around in the direction changing unit, the printed surface does not face the surfaces of the turn bars. Therefore, the printed surface can be prevented from being adversely affected due to coming into contact with a contact turn bar or air ejected from the static pressure surface of a non-contact turn bar.

Although the input units are used to introduce continuous sheets in the above embodiments, a plurality of cut sheets that have been cut into a certain length may be sequentially introduced. Alternatively, a continuous sheet input to an input unit may be automatically cut by a cutter before being subjected to printing in a printing apparatus, and the printed cut sheets may be output. In these embodiments, a conveying mechanism including rollers or belts for conveying the cut sheets one by one is provided for each line. In addition, in the direction changing unit 20, each turn bar is formed of a pair of rollers having a driving force for pinching and conveying the cut sheets, so that the cut sheets are automatically wound onto certain turn bars and conveyed.

The present invention is not limited to the above embodiments and various alterations and modifications are possible so long as the spirit and scope of the present invention are not deviated from. Therefore, the following claims are appended so as to make public the scope of the present invention.

According to the present invention, the distances over which rolls are carried between the processing lines and pre- and post-processing apparatuses are small, which makes the workload of a worker small. In addition, according to the present invention, the floor area in the factory required for the arrangement of the processing lines is small, which realizes a high density layout. In addition, according to the present invention, the number of processing lines can be flexibly increased.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of International Patent Application No. PCT/JP2010/055791, filed Mar. 31, 2010, which is hereby incorporated by reference herein in its entirety.

The invention claimed is:

1. A printing system capable of performing duplex printing and simplex printing, the printing system comprising:

a first printing apparatus;

a second printing apparatus;

a first input unit;

a second input unit adjacent to the first input unit;

a first output unit;

a second output unit adjacent to the first output unit; and a changing unit that changes a traveling direction of one or more sheets from a first direction to a second direction, the second direction intersecting the first direction at an angle, wherein the first and second printing apparatuses, the first and second input units, the first and second output units and the changing unit are arranged in an L-shaped area to form sheet traveling paths including a first path extending from the first input unit to the changing unit, a second path substantially parallel to the first path and extending from the second input unit to the changing unit, a third path extending from the changing unit to the first output unit, and a fourth path substantially parallel to the third path and extending from the changing unit to the second output unit, wherein the first printing apparatus is located in the first path and the second printing apparatus is located in the fourth path such that the first printing apparatus and the second printing apparatus are disposed along an inner side of the L-shaped area, and no printing apparatus is located in the second and third paths along an outer side of the L-shaped area, wherein, in the duplex printing, a sheet supplied from the first input unit travels in the first direction along the first path and is subjected to printing on a first side of the sheet with the first printing apparatus, then a traveling direction of the sheet is changed at the changing unit while a printing side of the sheet is reversed, and then the sheet travels in the second direction along the fourth path and is subjected to printing on a second side of the sheet which is a reverse of the first side with the second printing apparatus~and is output to the second output unit, and wherein, in the simplex printing, a first sheet supplied from the first input unit travels in the first direction along the first path and is subjected to printing on one side of the sheet with the first printing apparatus, then a traveling direction of the first sheet is changed at the changing unit such that the sheet travels in the second direction along the third path and is output to the first output unit, and a second sheet supplied from the second input unit travels in the first direction along the second path, then a traveling direction of the second sheet that has been supplied from the second input unit is changed at the changing unit such that the second sheet travels in the second direction along the fourth path and is subjected to printing on one side of the second sheet with the second printing apparatus and is output to the second output unit, wherein, in the simplex printing, the first sheet and the second sheet pass through the changing unit simultaneously in the first and second directions without coming into contact with each other.

2. The printing system according to claim 1, wherein the changing unit includes:

a first turn bar onto which, in the duplex printing, the sheet traveling in the first path is obliquely wound and ejected to the fourth path;

a second turn bar onto which, in the simplex printing, the sheet traveling in the first path is obliquely wound and ejected to the third path; and a third turn bar onto which, in the simplex printing, the sheet traveling in the second path is obliquely wound and ejected to the fourth path, wherein the first turn bar, the second turn bar and the third turn bar are supported with a same orientation.

3. The printing system according to claim 2, wherein a surface of the first turn bar faces the second side of the sheet and does not face the first side of the sheet.

4. The printing system according to claim 3, wherein a surface of the second turn bar faces the second side of the sheet and does not face the first side of the sheet.

5. The printing system according to claim 1, wherein the first path is provided inwardly relative to the second path, and the fourth part is provided inwardly relative to the third path.

6. The printing system according to claim 1, further comprising:

a drying apparatus capable of drying a sheet traveling along the third path and a sheet traveling along the fourth path after being printed simultaneously.

7. The printing system according to claim 1, further comprising:

a cutter unit that cuts printed sheets into a certain length before the printed sheets are output to the first output unit and the second output unit.

8. The printing system according to claim 1, wherein the first printing apparatus and the second printing apparatus perform printing by an inkjet method.

9. The printing system according to claim 1, wherein, in the simplex printing, the system is capable of performing two-time simplex-printing, and wherein, in the two-time simplex-printing, the first sheet introduced to the first path from the first input unit is subjected to printing on the first side of the first sheet with the first printing apparatus, then a traveling direction of the first sheet is changed at the changing unit while the first sheet is reversed twice and ejected to the fourth path, and then the first sheet is subjected to printing on the first side with the second printing apparatus and output to the second output unit.

10. The printing system according to claim 1, further comprising:

an additional changing unit provided adjacent to the changing unit;

a third input unit provided adjacent to the first input unit;

a fourth input unit provided adjacent to the third input unit;

a third printing apparatus provided upstream of the additional changing unit in the first direction;

a fourth printing apparatus provided downstream of the additional changing unit in the second direction;

a third output unit provided adjacent to the second output unit; and a fourth output unit adjacent to the third output unit, wherein the third and fourth printing apparatuses, the third and fourth input units, the third and fourth output units and the additional changing unit are arranged on an additional L-shaped area adjacent to the L-shaped area to form sheet traveling paths including a fifth path extending from the third input unit to the additional changing unit, a sixth path substantially parallel to the fifth path and extending from the fourth input unit to the additional changing unit, a seventh path extending from the additional changing unit to the third output unit, and an eight path substantially parallel to the seventh path and extending from the additional changing unit to the fourth output unit, and wherein the third printing apparatus is located in the sixth path and the fourth printing apparatus is located in the eight path such that the third printing apparatus and the fourth printing apparatus are disposed along an outer side of the additional L-shaped area, and no printing apparatus is located in the fourth and seventh paths along an inner side of the additional L-shaped area.

11. The printing system according to claim 9, wherein the changing unit includes:

a first turn bar onto which the sheet that has been subjected to printing with the first printing apparatus and that is traveling in the first direction is obliquely wound, thereby changing the traveling direction of the sheet to a direction opposite to the second direction; and a second turn bar onto which the sheet that has passed onto the first turn bar is non-obliquely wound, thereby changing the traveling direction of the sheet to the second direction to cause the sheet to travel along the fourth path towards the second printing apparatus.

12. The printing system according to claim 11, wherein the first turn bar and the second turn bar both face the second side and do not face the first side.

13. A sheet processing system capable of performing duplex processing and simplex processing, the processing system comprising:

a first printing apparatus;

a second printing apparatus;

a first input unit;

a second input unit adjacent to the first input unit;

a first output unit;

a second output unit adjacent to the first output unit; and a changing unit that changes a traveling direction of one or more sheets from a first direction to a second direction, the second direction intersecting the first direction at an angle, wherein the first and second printing apparatuses, the first and second input units, the first and second output units and the changing unit are arranged in an L-shaped area to form sheet traveling paths including a first path extending from the first input unit to the changing unit, a second path substantially parallel to the first path and extending from the second input unit to the changing unit, a third path extending from the changing unit to the first output unit, and a fourth path substantially parallel to the third path and extending from the changing unit to the second output unit, wherein the first printing apparatus is located in the first path and the second printing apparatus is located in the fourth path such that the first printing apparatus and the second printing apparatus are disposed along an inner side of the L-shaped area, and no printing apparatus is located in the second and third paths along an outer side of the L-shaped area, wherein, in the duplex processing, a sheet supplied from the first input unit travels in the first direction along the first path and is subjected to processing on a first side of the sheet with the first printing apparatus, then a traveling direction of the sheet is changed at the changing unit while a printing side of the sheet is reversed, and then the sheet travels in the second direction along the fourth path and is subjected to processing on a second side of the sheet which is a reverse of the first side with the second printing apparatus and is output to the second output unit, and wherein, in the simplex processing, a first sheet supplied from the first input unit travels in the first direction along the first path and is subjected to processing on one side with the first printing apparatus, then a traveling direction of the first sheet is changed at the changing unit such that the first sheet travels in the second direction along the third path and is output to the first output unit, and a second sheet supplied from the second input unit travels in the first direction along the second path, then a traveling direction of the second sheet that has been supplied from the second input unit is changed at the changing unit such that the second sheet travels in the second direction along the fourth path is subjected to processing on one side with the second printing apparatus and is output to the second output unit, wherein, in the simplex printing, the first sheet and the second sheet pass through the changing unit simultaneously in the first and second directions without coming into contact with each other.

* * * * *